United States Patent [19]

Johnson

[11] Patent Number: 4,630,050

[45] Date of Patent: Dec. 16, 1986

[54] DUAL PURPOSE GUIDANCE SYSTEM FOR A GUIDED MISSILE

[75] Inventor: Robert H. Johnson, Scottsdale, Ariz.

[73] Assignee: Motorola, Inc., Schaumburg, Ill.

[21] Appl. No.: 562,934

[22] Filed: Dec. 19, 1983

[51] Int. Cl.[4] ..... F42B 15/02; F42C 13/04

[52] U.S. Cl. ..... 342/62; 102/214; 244/3.19; 342/68

[58] Field of Search ..... 343/7 PF, 7 ED; 244/3.19; 102/214

[56] References Cited

U.S. PATENT DOCUMENTS

| | | | |
|---|---|---|---|
| 3,698,811 | 10/1972 | Weil | 343/7 ED X |
| 4,100,545 | 7/1978 | Tabourier | 343/7 ED |
| 4,160,974 | 7/1979 | Stavis | 343/7 ED X |
| 4,256,275 | 3/1981 | Flick et al. | 343/7 ED X |
| 4,321,871 | 3/1982 | Abadie | 102/214 |

*Primary Examiner*—T. H. Tubbesing

*Attorney, Agent, or Firm*—Eugene A. Parsons

[57] ABSTRACT

A guided missile having a radar system which is utilized as a target seeker and tracking radar as long as it is capable of tracking the target through the encounter, after which, or at some set distance from the target, the radar and associated circuitry provides the optimum burst time.

8 Claims, 5 Drawing Figures

DUAL PURPOSE GUIDANCE SYSTEM FOR A GUIDED MISSILE

BACKGROUND OF THE INVENTION

Subsequent to launch of a guided missile there are two basic phases of operation through which the missile must progress. In the first phase of operation the missile must seek, lock on and track a target. As the missile approaches the target the second phase of operation is initiated. In the second phase of operation the missile must measure various target parameters, calculate an optimum burst time, and detonate when the measured parameters indicate that the optimum burst time as been reached.

In all prior art active-guided missiles the first phase of operation is provided by a relatively large radar, laser, infra-red sensor, etc. having an antenna with scanning capablities, such as a gimbled platform, attached thereto. The tracking device continues to track the target as long as it is capable of controlling the guidance apparatus of the missile.

The second function of the guided missile is provided by a second radar, or other sensor, which has the capabilities of determining the angle of the target from the missile and the speed of the target relative to the missile. A computer on the missile then utilizes these parameters, along with certain missile parameters to calculate the optimum burst time for the missile. The second radar continues to operate until the optimum burst time is reached, at which time it detonates the missile.

Because of the two separate radar systems the missile must carry substantial additional weight and the cost of the two systems greatly increases the overall cost of the missile.

SUMMARY OF THE INVENTION

The present invention pertains to a system for a guided missile with a single radar transceiver in the missile, which transceiver may be a radar, laser, etc., having first means coupled thereto for providing guidance control signals and second means for calculating optimum initiation time and providing a signal indicative of the occurrence of said optimum initiation time. The first means continues to guide the missile after acquiring a target, for as long as possible, and the second means continues to update the optimum initiation time until the transceiver can no longer track the target at which time the second means begins a count down to the optimum initiation time and initiation at the occurrence of that time.

It is an object of the present invention to provide a new and improved dual purpose system for guided missiles.

It is a further object of the present invention to provide a new and improved system for guided missiles having the dual function of seeking/tracking and target detecting.

These and other objects of this invention will become apparent to those skilled in the art upon consideration of the accompanying specification, claims and drawings.

BRIEF DESCRIPTION OF THE DRAWINGS

Referring to the drawings.

BRIEF DESCRIPTION OF THE PRIOR ART

Figure 1:
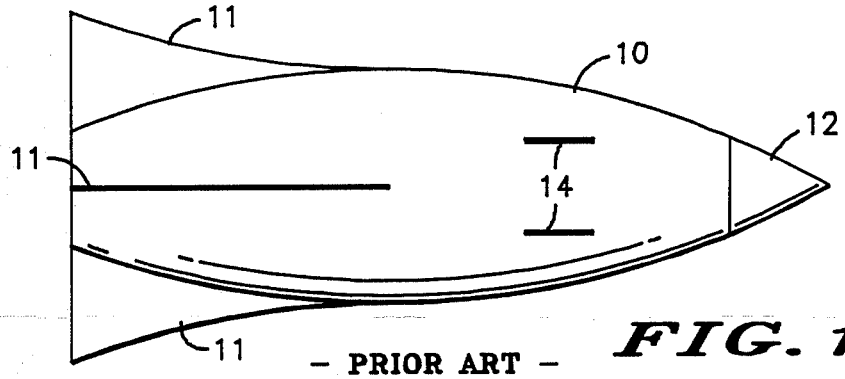
FIG. 1 is a view of a missile having prior art radars mounted thereon.

Referrring specifically to FIG. 1, a guided missile 10 includes some form of propulsion and some means of controlling the flight thereof, such as moveable fins 11. The nose of the missile is formed of a radome 12 housing a radar system with a scanning antenna for seeking and tracking a target. The sole purpose of the radar system housed within the radome 12 is to seek a specific target and then home on that target by providing control signals to the control system of the missile 10.

A second radar system is housed within the body of the missile 10 and antennas therefor, such as slot, antennas 14 are positioned on the body of the missile 10 to provide a direction sensing function. Generally, the slot antennas 14 will be dispersed around the body of the missile 10 so as to provide a signal indicative of the direction of the target, as well as the distance of the target from the missile. The two radar systems operate at substantially different frequencies so as not to interfere with each other. When the radar system associated with slot antennas 14 senses that the target is in an optimum position relative to missile 10 an initiation pulse is supplied to the warhead.

It should be noted that in some instances, due to high manueverability of the target, or other reasons, the missile 10 may not be able to track the target to a collision course. As the missile 10 approaches the target on a near miss course the antenna of the seeker/tracking radar in the nose of missile 10 will not be able to slew far enough to continue tracking the target, at which time the target will be lost and control of the missile 10 will be lost. At this time the radar system associated with the slot antennas 14 takes over completely and provides the target detecting function. The major problem with this apparatus is that two complete radar systems must be provided with antennas mounted in different positions to provide the seeker/tracking function and the target detecting function. The two systems add additional weight to the missile as well as substantial additional cost and the inconvenience of mounting the target detecting radar system at some position along the body of the missile so that it does not interfere with the flight but provides the direction and distance to the target readings.

DESCRIPTION OF THE PREFERRED EMBODIMENT

Figure 2:
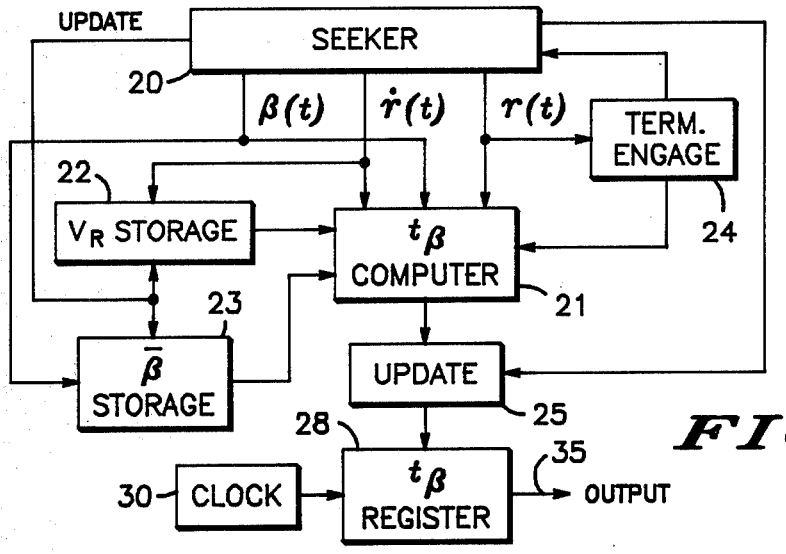
FIG. 2 is a simplified block diagram of a radar system for a guided missile embodying the present invention.

Referring specifically to FIG. 2, a simplified block diagram of a single radar system embodying the present invention is illustrated. The system includes a seeker/-tracking radar 20 having attached thereto a computer 21 for calculating the optimum initiation time of the warhead. A long range relative velocity, $V_R$, storage unit 22 is connected to the seeker 20 and the computer 21. A long range seeker angle, $\dot{\beta}$, storage unit 23 is connected to seeker 20 and the computer 21. A terminal engagement sensing circuit 24 is connected to range output and supplies signals to computer 21 and seeker 20. A signal indicative of the optimum initiation time is supplied by the computer 21 to an update circuit 25, which also receives a signal from the seeker radar 20 indicative of whether the seeker 20 radar is tracking the target. An output signal from the update 25 is applied to a register 28, which also receives clock pulses from a clock 30. The register 28 supplies an output signal at a terminal 35 which initiates the warhead of the missile.

Figure 3:
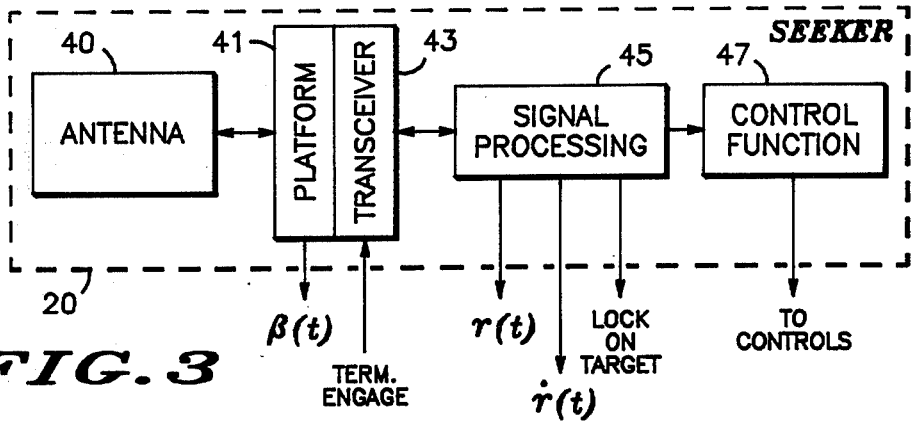
FIG. 3 is simplified block diagram of a portion of the apparatus illustrated in FIG. 2.

Referring specifically to FIG. 3, the seeker 20 of FIG. 2 is illustrated in more detail. In this specific embodiment the seeker 20 includes an antenna 40 affixed to a platform 41 in the usual manner. It will of course be understood by those skilled in the art that while a mechanical scanning system is illustrated for the seeker 20, other scanning systems, such as electronic or optical, might by utilized. The antenna 40 is electrically coupled to a transceiver 43 for transmission and reception of signals. The transceiver 43 is connected to signal processing circuitry 45 which processes the received signals to provide signals to control function apparatus 47. The control function apparatus 47 is connected to the controlling apparatus such as fins or the like. The signal processing circuitry 45 provides output signals indicative of r(t), range from target to missile at time (t) $\dot{r}(t)$, radial velocity along the line of sight, and whether the radar is locked on the target. A signal indicative of $\beta(t)$, the seeker to target angle at time (t), is also provided by the platform 41. The $\beta(t)$ signal from the platform 41 is supplied to the computer 21 and the storage unit 23. The r(t) signal is supplied to the computer 21. The $\dot{r}(t)$ signal is supplied to the computer 21 and the storage 22. The lock on target signal is supplied to the update unit 25, the storage unit 22 and the storage unit 23.

In the operation of the radar system illustrated in FIG. 2, the seeker 20 seeks out and locks on a target. The seeker 20 continues to track the target to some predetermined range (terminal engagement), for example, when the terminal engagement circuit 24 determines that the target is about 1000 feet away. Circuit 24 may be, for example, a comparator having a terminal engagement range preset therein. During the terminal engagement the antenna 40 is slewed at maximum rates and the track bandwidths of the transceiver are widened to provide tracking as long as possible. Also, during the terminal engagement the pulse width of the pulses transmitted by transceiver 43 may be reduced to improve the short range tracking. Also, in some instances it may be desirable to reduce the power levels of the radar transmitter during the terminal engagement. The advantages and disadvantages of these various modifications of the radar will be evident to those skilled in the art and will not be discussed in detail herein.

In addition to the above described modifications, the computer 21 and associated circuitry of FIG. 2 is connected to the seeker 20 to provide the target detection function. As the seeker 20 tracks the target, $\beta(t)$ is supplied to storage unit 23 and continually updated (essentially averaged) so that the output of storage unit 23 is long range seeker angle, $\overline{\beta}$. Similarly, the radial velocity along the line of sight, $\dot{r}(t)$ is supplied to the storage unit 22 and continuously updated so that the output of the storage unit 22 is essentially the average velocity, or the long range closing velocity, $V_R$. Also, the seeker 20 supplies the signal to the storage units 22 and 23 that the seeker 20 is locked on the target and that the updates are valid. In addition to the above parameters, the computer 21 has stored therein an indication of the warhead velocity, $V_W$. The computer 21 utilizes these various parameters to calculate the optimum initiation time for the warhead. An estimate of the time required for the target to reach the warhead effects plane (a plane defined by warhead particles after detonation) less the time for the warhead to travel after burst is estimated by the computer 21 at the initiation of the terminal engagement, in accordance with the following equation:

$$\Delta t_\beta = \frac{r(t)}{\cos\overline{\beta}}\left\{\frac{\cos\beta(t)}{V_R} - \frac{\sqrt{\sin^2(\beta(t)-\overline{\beta}) + 2\cos\overline{\beta}\cos\beta(t)\left[\cos(\beta(t)-\overline{\beta}) + \frac{\dot{r}(t)}{V_R}\right]}}{V_W}\right\} \quad (1)$$

the estimate of $\Delta t_\beta$ is continuously updated by the computer as long as the seeker 20 continues to indicate that the target is in lock. At loss of target the seeker 20 provides an indication to the update unit 25 which then sets the register 28 to the optimum initiation time and the register 28 is clocked down to zero by the clock 30 at which time the warhead is detonated by an output signal at terminal 35. To provide adequate burst control, an accuracy of 0.1 milliseconds is provided in the register 28. In this embodiment the register 28 has a minimum of 12 stages.

Figure 4:
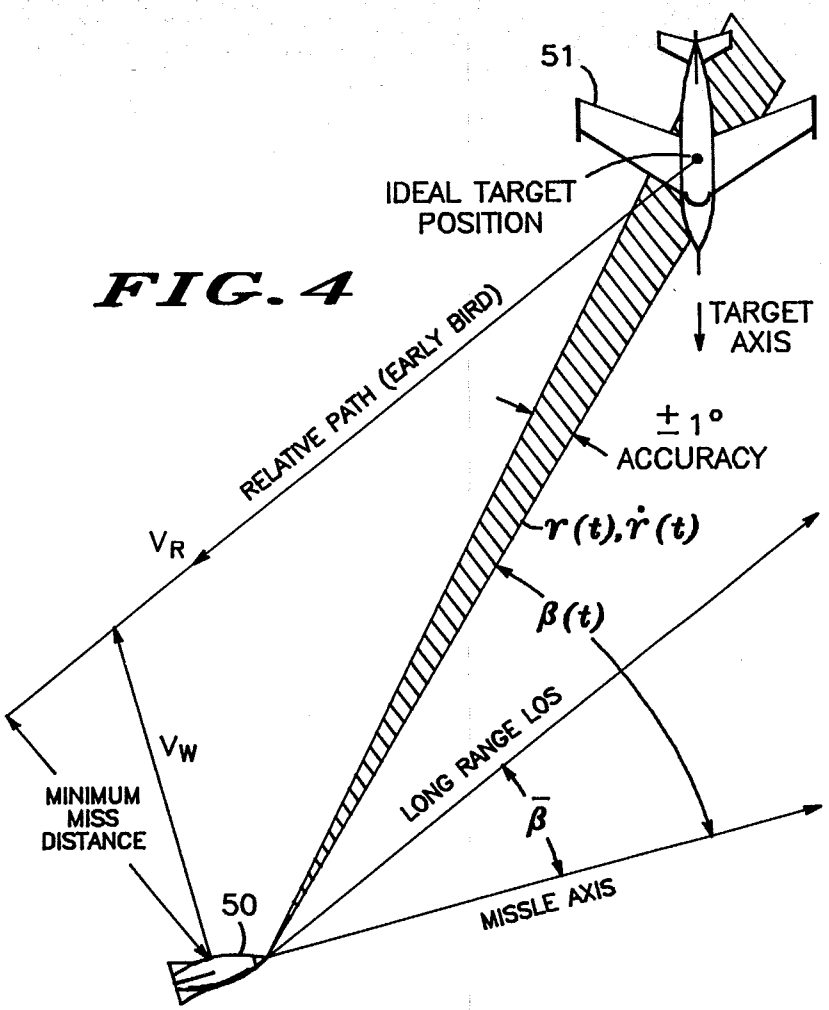
FIG. 4 depicts typical intercept conditions between a guided missile and a target.
Figure 5:
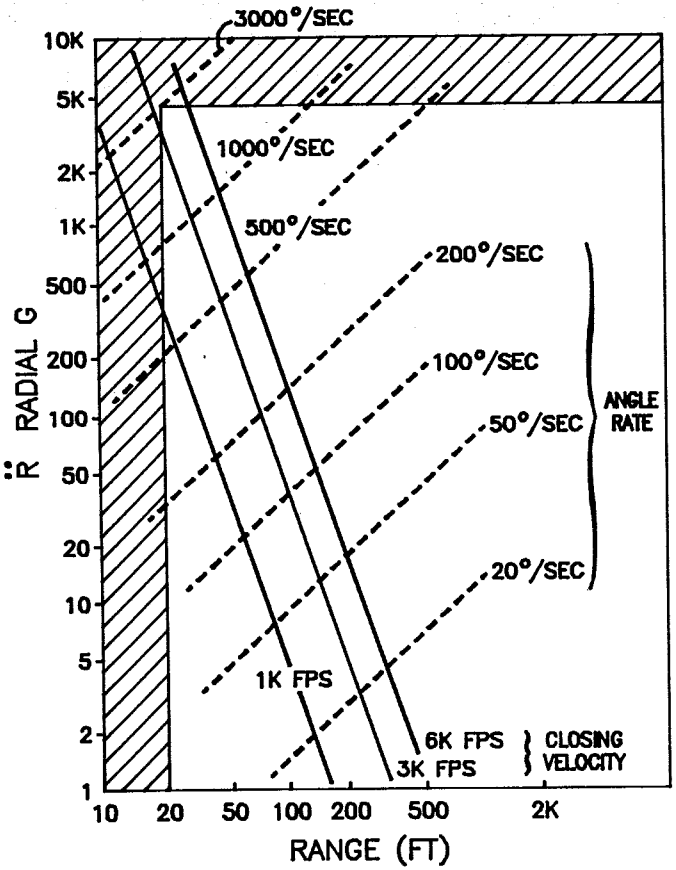
FIG. 5 illustrates some of the dynamics in the terminal phase for a typical air-to-air encounter for a closest approach of ten feet.

FIG. 4 illustrates intercept conditions for a guided missile 50 and a target 51. The various parameters provided by the seeker 20 or averaged through the use of storage units 22 and 23 are illustrated in this figure. From the geometry of FIG. 4 the optimum initiation time can be determined from the equation (1) above. FIG. 5 presents some of the dynamics in the terminal engagement phase for a typical air to air encounter for a closest approach of ten feet.

Thus, a single radar system for a guided missile is described wherein the radar system is utilized as a seeker/tracking radar and, during a terminal engagement, is utilized for the additional function of target detection. When the missile 50 approaches the target 51 on a near miss course and the seeker 20 ultimately loses the target 51, the present system continues to count down to the optimum initiation and detonates the warhead at the optimum time. Thus, the present system performs the functions of the prior art with a single radar thereby eliminating the need for separate antennas and covers or installations therefor, transmitters, receivers, and processors. The elimination of this excess equipment substantially reduces the size, weight and cost of the missile.

While I have shown and described a specific embodiment of this invention, further modifications and improvements will occur to those skilled in the art. I desire it to be understood, therefor, that this invention is not limited to the particular form shown and I intend in the appended claims to cover all modifications which do not depart the spirit and scope of this invention.

I claim:

1. A guidance system for a guided missile comprising a transceiver with first means coupled thereto for providing guidance control signals to the missile during a seeking portion of flight and second means coupled to said transceiver and said first means for calculating optimum initiation time based on a stored estimate of the time required for the target to reach a reference plane and providing a signal indicative of the occurrence of said optimum initiation time.

2. A guidance system for a guided missile as claimed in claim 1 wherein the transceiver is a radar that includes an antenna and means for scanning attached thereto, said means for scanning providing an output signal, $\beta(t)$, indicative of missile to target angle at time, t.

3. A guidance system for a guided missile as claimed in claim 2 wherein said first means includes processing means for providing signals, r(t), indicative of range from a target to the missile, and $\dot{r}(t)$, indicative of relative radial velocity between the target and the missile.

4. A guidance system for a guided missile comprising a radar transceiver that includes an antenna and scanning means attached thereto wherein said scanning means provides an output signal $\beta(t)$, first means coupled to said transceiver for providing guidance control signals during a seeking portion of flight wherein said first means includes processing means for providing signals r(t) and $\dot{r}(t)$, and second means coupled to said transceiver and said first means for calculating optimum initiation time and providing a signal indicative of the occurrence of said optimum initiation time wherein said second means includes circuitry for calculating $\Delta t_\beta$ which is defined as the time required for the target to reach a missile particle effects plane less the time for the missile to travel after initiation, where $$\Delta t_\beta = \frac{r(t)}{\cos\bar{\beta}}\left\{\frac{\cos\beta(t)}{V_R} - \frac{\sqrt{\sin^2(\beta(t)-\bar{\beta}) + 2\cos\bar{\beta}\cos\beta(t)\left[\cos(\beta(t)-\bar{\beta}) + \frac{\dot{r}(t)}{V_R}\right]}}{V_W}\right\}$$

r(t)=range from a target to a missile at time, t,
r(t)=relative radial velocity between the target and the missile at time, t,
$V_R$=long range closing velocity,
$\bar{\beta}$=long range missile to target angle, and
$V_W$=warhead velocity
$\beta(t)$=missile to target angle at time, t.

5. A guidance system for a guided missile as claimed in claim 4 wherein said first means provides a signal indicative of loss or target track to said second means and said second means includes timing means coupled to receive the signal indicative of loss of target track and the optimum initiation time for continuing to count from the loss of target track to the optimum initiation time.

6. A guidance system for a guided missile as claimed in claim 5 wherein the timing means includes a clocked register.

7. A guidance system for a guided missile as claimed in claim 6 wherein the register includes a minimum of twelve stages.

8. A guidance system for a guided missile as claimed in claim 7 including in addition circuitry for sensing a predetermined range to a target and altering preselected parameters of said radar transceiver to facilitate short range tracking.

* * * * *